US009272503B2

(12) United States Patent
Butschko et al.

(10) Patent No.: US 9,272,503 B2
(45) Date of Patent: Mar. 1, 2016

(54) SEAL FOR DOCTOR BLADE DEVICES AND DOCTOR BLADE DEVICE HAVING A SEAL

(71) Applicant: HEIDELBERGER DRUCKMASCHINEN AG, Heidelberg (DE)

(72) Inventors: Sven Butschko, Dossenheim (DE); Joerg Schilfahrt, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/317,165

(22) Filed: Jun. 27, 2014

(65) Prior Publication Data

US 2015/0001806 A1 Jan. 1, 2015

(30) Foreign Application Priority Data

Jun. 27, 2013 (DE) ..... 10 2013 010 751

(51) Int. Cl.
*B41F 9/10* (2006.01)
*B41F 31/02* (2006.01)

(52) U.S. Cl.
CPC ..... *B41F 9/1063* (2013.01); *B41F 31/027* (2013.01)

(58) Field of Classification Search
CPC ..... B41F 3/1063; B41F 9/065; B41F 9/068; B41F 31/027; B41F 31/02; F16J 15/3232; F16J 15/3204; F16J 15/32
See application file for complete search history.

(56) References Cited

U.S. PATENT DOCUMENTS

| | | | | |
|---|---|---|---|---|
| 5,182,992 | A | 2/1993 | Rogge | |
| 5,497,702 | A | 3/1996 | Gorter | |
| 6,016,748 | A | 1/2000 | Kolbe et al. | |
| 6,739,248 | B2 * | 5/2004 | Kolbe et al. | 101/169 |
| 7,597,761 | B2 * | 10/2009 | Van Denend | 118/410 |
| 2009/0193990 | A1 | 8/2009 | Van Denend | |
| 2011/0056395 | A1 * | 3/2011 | Gydesen et al. | 101/208 |
| 2014/0373740 | A1 * | 12/2014 | Fogh-Hansen | 101/367 |

FOREIGN PATENT DOCUMENTS

| | | | |
|---|---|---|---|
| DE | 4241792 | A1 | 6/1994 |
| DE | 202009013643 | U1 | 3/2011 |
| EP | 0438731 | A2 | 7/1991 |
| EP | 0941846 | A1 | 9/1999 |
| EP | 0949074 | A1 | 10/1999 |

* cited by examiner

*Primary Examiner* — Daniel J Colilla
*Assistant Examiner* — Leo T Hinze
(74) *Attorney, Agent, or Firm* — Laurence A. Greenberg; Werner H. Stemer; Ralph E. Locher

(57) ABSTRACT

A seal for a doctor blade device in a printing press includes a blade contacting section with a front side engaged with a doctor blade of the doctor blade device and a rear side that is softer, more elastic or more resilient than the front side. A doctor blade device having a seal is also provided.

8 Claims, 4 Drawing Sheets

SEAL FOR DOCTOR BLADE DEVICES AND DOCTOR BLADE DEVICE HAVING A SEAL

CROSS-REFERENCE TO RELATED APPLICATION

This application claims the priority, under 35 U.S.C. §119, of German Patent Application DE 10 2013 010 751.2, filed Jun. 27, 2013; the prior application is herewith incorporated by reference in its entirety.

BACKGROUND OF THE INVENTION

Field of the Invention

The present invention relates to a seal for doctor blade devices in printing presses. The invention also relates to a doctor blade device having a seal.

Printing presses include anilox inking units and varnishing units with screen rollers and co-operating doctor blade devices such as chambered doctor blades, which have two doctor blades (working blade and closing blade), and blade-type ink fountains with only one doctor blade (working blade). Such a doctor blade device has a rubbery-elastic seal on each of its ends which is engaged with the screen roller and the doctor blade or blades.

When the doctor blade moves relative to the seal, the area of contact between the seal and the doctor blade is prone to leakage. Such movement of the doctor blade occurs, for instance, when the doctor blade is bent while it is in engagement with the screen roller.

U.S. Patent Application Publication No. 200910193990A1 discloses a seal for a chambered doctor blade. The seal has a respective blade contacting section on each end. In the region of one blade contacting section, the seal is engaged with the working blade and in the region of the other blade contacting section, the seal is engaged with the closing blade. A roller contacting section in which the seal is engaged with the screen roller is situated between the two blade contacting sections.

In order to solve the leakage problem, the prior art indicated above proposes to equip the seal with a pair of protruding wings in each blade contacting section. The wings provide greater flexibility or elasticity and thus have an improved ability to follow the movements of the doctor blade. The wings are disposed on the front side, i.e. the side of the blade contacting section that is engaged with the doctor blade. However, the wings wear easily, causing renewed leakage and resulting in a shorter useful life.

SUMMARY OF THE INVENTION

It is accordingly an object of the invention to provide a seal for doctor blade devices and a doctor blade device having a seal, which overcome the hereinafore-mentioned disadvantages of the heretofore-known devices of this general type and which provide a low-wear seal that is less prone to leakage.

With the foregoing and other objects in view there is provided, in accordance with the invention, a seal for doctor blade devices in printing presses, comprising a blade contacting section with a front side engaged with the doctor blade and a rear side being softer, more elastic or more flexible than the front side.

The invention is based on the realization that it is not expedient to assign increased flexibility or elasticity of the blade contacting section to the front side thereof. Instead, the opposite is the case, i.e. it is expedient to assign an increased flexibility or elasticity of the blade contacting section to the rear side. The result is that the inherent dimensional stability of the front side is maintained, resulting in reduced wear. The rear side forms a resilient element that ensures that the engagement between the seal in the region of the blade contacting section and the doctor blade is maintained to prevent leakage. In the region of the blade contacting section the liquid provided in the doctor blade device, e.g. the printing ink or varnish, is prevented from leaking from the doctor blade device between the seal and the doctor blade.

The seal of the invention is not sensitive to changing loads such as the ones that occur when the doctor blade device is engaged with and disengaged from the screen roller. In practice, blade-type ink fountains are engaged and disengaged more frequently than chambered doctor blades since blade-type ink fountains are more suited for frequent engagements and disengagements due to their construction that does not require them to be emptied before being disengaged as is the case with chambered doctor blades. Against this background, the seal of the invention is particularly suited for use in blade-type ink fountains.

With the objects of the invention in view, there is concomitantly provided a doctor blade device, in particular a blade-type ink fountain that is equipped with two seals of the invention.

Other features which are considered as characteristic for the invention are set forth in the appended claims.

Although the invention is illustrated and described herein as embodied in a seal for doctor blade devices and a doctor blade device having a seal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
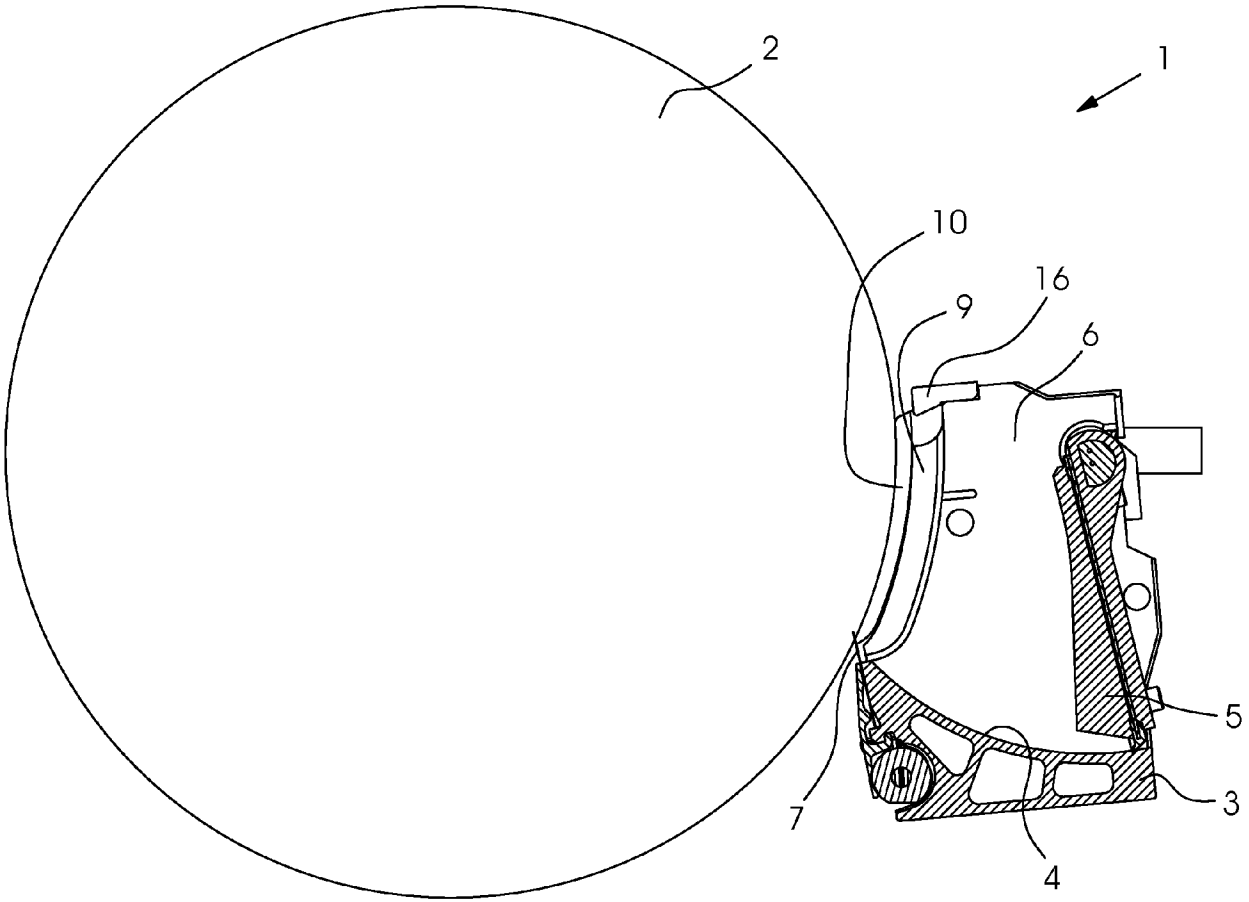
FIG. 1 is a diagrammatic, partly-sectional, side-elevational view of a screen roller and doctor blade device.

Referring now to the figures of the drawings in detail and first, particularly, to FIG. 1 thereof, there is seen a section of a printing press 1 for lithographic or planographic offset printing on sheets. The section includes an anilox inking unit with a screen roller 2 and a doctor blade device 3. The doctor blade device 3 has a concave bottom 4, a pivotable rear wall 5, two side walls 6 and a single doctor blade 7 clamped to the bottom 4 and negatively engaged with the screen roller during operation to act as a working blade. The doctor blade device 3 is not a chambered doctor blade but a blade-type ink fountain, which is different from the former. The doctor blade device 3 has a supply chamber 8 (see FIG. 2) defined by the bottom 4, by the rear wall 5, and by the side walls 6 at the lateral ends of the doctor blade device 3. The supply chamber 8 has a refill opening at its top and is thus open towards the environment. The supply chamber 8 contains a fluid—the ink—that is to be fed to the screen roller by using the doctor blade device 3. For reasons of clarity, this fluid supply is not shown in the drawing.

The rear wall 5 is pivotable towards the doctor blade 7 to increase the level of the fluid to a level above a blade edge that is engaged with the screen roller 2 by displacement of the fluid. In order to lower the level below the edge for maintenance and set-up work that requires the doctor blade device 3 to be disengaged from the screen roller 2 such as for an ink change, the rear wall 5 is pivotable away from the doctor blade 7 into the illustrated position.

Figure 2:
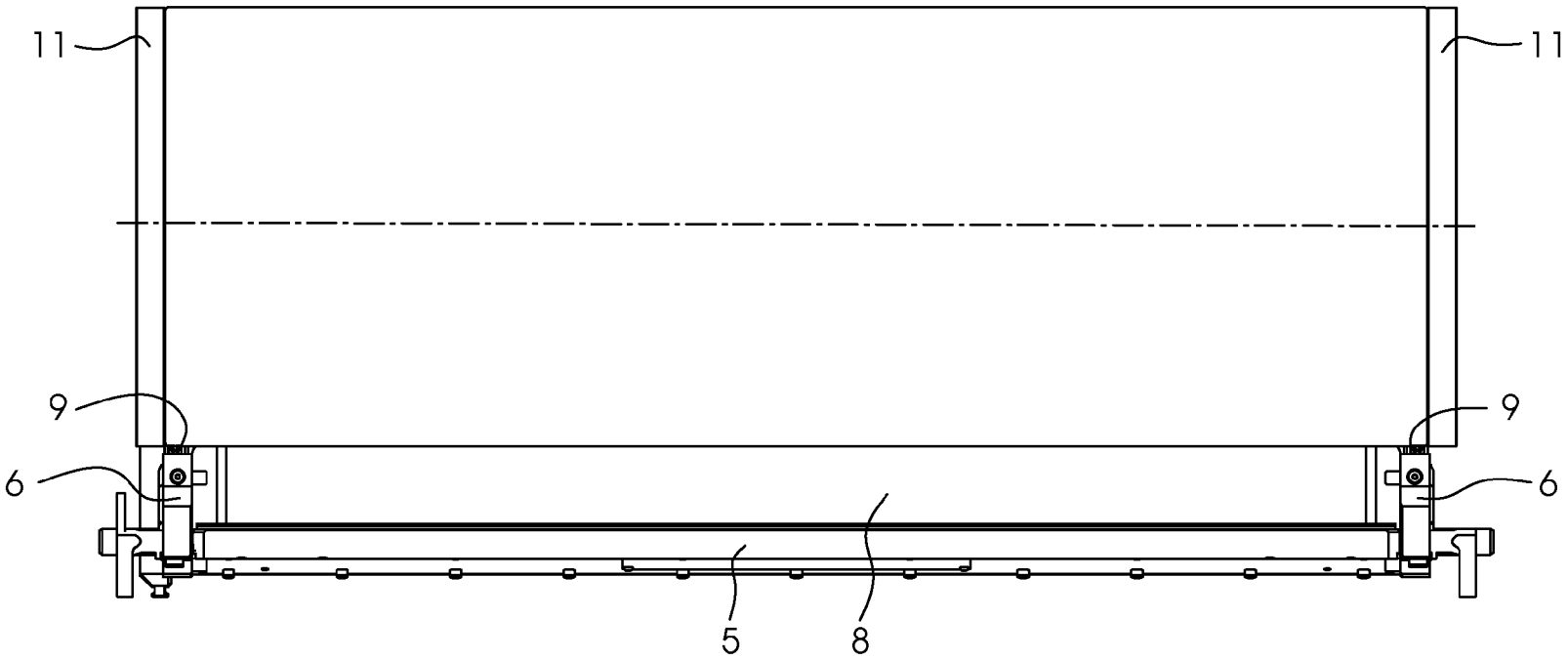
FIG. 2 is a front-elevational view of the screen roller and doctor blade device of FIG. 1.

As shown in FIG. 2, one of the rear walls 6 is on the operator side of the printing press 1 and the other side wall is on the drive side. The two side walls are parallel to each other and perpendicular to the axis of rotation of the screen roller 2 and have respective rubbery-elastic seals 9 of a synthetic material such as polyurethane. A respective seal 9 is connected to a respective side wall by an easily releasable push-on connection. When the entire doctor blade device 3 is engaged with the screen roller 2, the doctor blade 7 and the two seals 9 are brought into contact with the screen roller 2. During the printing operation, the edge of the doctor blade 7 and lips 10 (see FIG. 4) of the seals 9 are engaged with the circumferential surface of the screen roller 2, with the seals 9 engaging the screen roller 2 immediately adjacent bearer rings 11 provided at ends of the screen roller 2 in a longitudinal section situated between the two bearer rings 11.

The two seals 9 are identical parts, a fact that is advantageous in manufacturing terms, and each one is compatible with the drive-side wall 6 and with the operator side wall 6.

Figure 3:
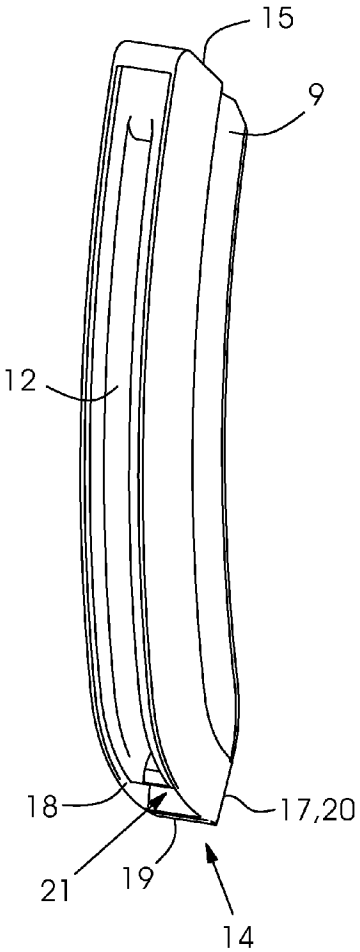
FIG. 3 is an enlarged perspective view of a seal of the doctor blade device of FIGS. 1 and 2.

FIG. 3 is a three-dimensional representation of one of the seals 9. A seal surface that is intended to face the side wall 6 has a convex shape in the longitudinal direction of the seal 9 and has a plug-on or connecting groove 12 that extends almost across the entire length of the seal 9. The groove 12 is provided to fit the seal 9 pushed onto the side wall 6 and may also be referred to as an attachment groove.

Narrow depressions such as grooves are known to be difficult to clean, for instance because it is difficult for an operator to introduce a cleaning cloth into the depression. However, that disadvantage does not apply to the groove 12 because a thorough cleaning of the seal 9 is not necessary since the seal 9 is constructed to be disposable. If printing ink gets into the groove 12 and contaminates it, potentially contaminating the ink of a following print job, the seal 9 does not have to be cleaned in a time-consuming process. Instead, the seal 9 may simply be replaced by a new, clean seal.

A complementary protrusion or protrusions (connecting webs 13 seen in FIG. 5) that positively or accurately fit into the connecting groove 12 when the seal 9 is fitted onto the side wall 6 are easily cleaned using a cleaning cloth, a brush or the like once the seal 9 has been removed from the side wall since, in contrast to the inner corner angles of a groove, the outer corner angles of the protrusion(s) are easily accessible.

The upper end and the lower end of the seal 9 have different contours: the upper end is obtuse and the lower end has a wedge-shaped tip 14. When the seal 9 is correctly fitted onto the side wall 6, the upper end forms an engagement surface 15 with which the seal 9 rests against a stop 16 (see FIGS. 1 and 5) disposed on the side wall 6 and blocks any displacement of the seal 9 away from the doctor blade 7. The lower end forms a blade contacting section 20 in the area of which the doctor blade 7 and the seal 9 are engaged with each other.

The blade contacting section 20 has a front side 17 and a rear side 18, which coincide in an edge 19 of the tip 14. The front side 17 is on the same side of the seal 9 as the lips 10 (see FIG. 4). The rear side 18 is on the same side of the seal 9 as the connecting groove 12. A first recess or pocket 21 that is aligned with the connecting groove 12 and disposed between the latter and the edge 19 is formed in that bent surface of the seal 9 in which the connecting groove 12 is formed. The first pocket 21 is wider than the connecting groove 12 and deeper than a second recess or second pocket 22 (see FIG. 4) that is formed in the seal 9 between the lips 10 and the edge 19. Only a thin frame of the synthetic material remains around the first pocket 21, and likewise only a thin frame of the material of the seal 9 remains around the second pocket 22. A common separation wall of the connecting groove 12 and the first pocket 21 is part of the frame around the first pocket 21. The frame around the second pocket 22 is open in the region situated between the lips 10, resulting in a substantially U-shaped construction.

The fact that the dimensions of the pockets 21, 22 are adapted to each other ensures that when pressure is exerted on the blade contacting section 20 or the front side 17 thereof by the doctor blade 7 engaged therewith, the rear side 18 with the first pocket 21 reacts in a softer, more resilient or elastic way than the front side 17 with the second pocket 22 because the front side 17 is more dimensionally stable than the rear side 18. Thus, it is substantially the rear side 18 and not the front side 17 that forms a spring system for the blade contacting section 20 and keeps the blade contacting section 20 in continuous contact with the doctor blade 7 even when the doctor blade 7 moves or is deformed, a contact that is firm or close enough to prevent fluid from leaking in the region of the blade contacting section 20.

Figure 4:
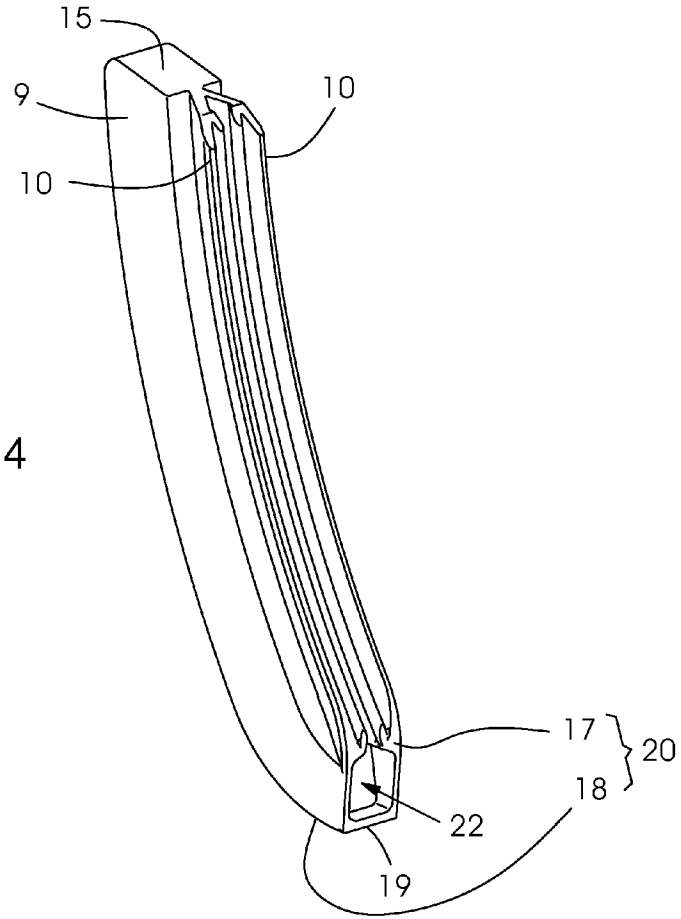
FIG. 4 is a different perspective view of the seal of FIG. 3.

As shown in FIG. 4, the lips 10 form a V-shaped cross section with two legs, each leg in turn branching out into two V-shaped branches on its free end.

Figure 5:
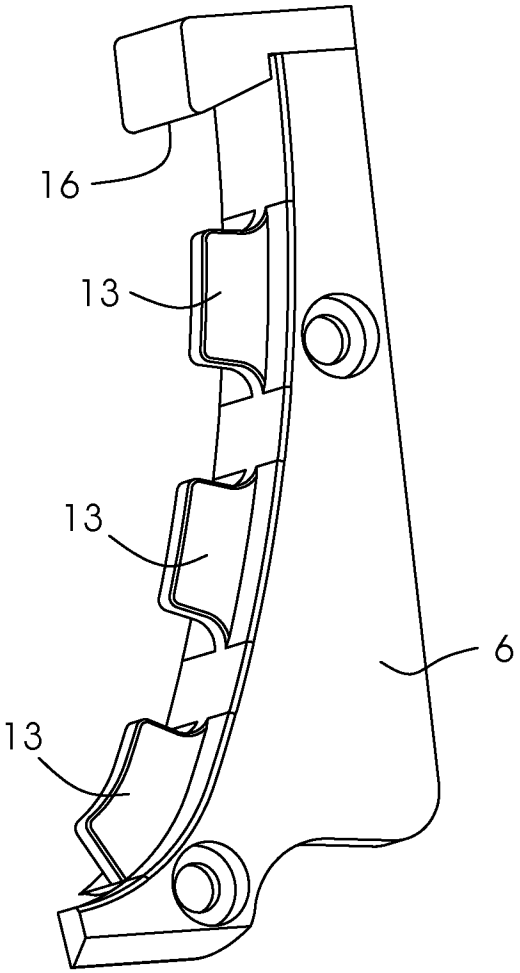
FIG. 5 is a perspective view of a portion of a side wall of the doctor blade device shown in FIGS. 1 and 2.

As shown in FIG. 5, the stop 16 has a wedge-shaped undercut that secures the seal 9 against unintentionally coming off the side wall 6. The figure also shows that the connecting webs 13 are disposed to be aligned with each other in a row along the concave front side of the side wall 6. The width of the connecting webs 13 is dimensioned in such a way that the connecting groove 12 (see FIG. 3) may be snugly slipped over the connecting webs 13 under a slight elastic widening of the connecting groove 12. In addition to the wedge-shaped undercut of the stop 16, the comparatively snug fit of the seal 9 on the connecting webs 13 additionally protects the seal 9 against sliding off the side wall 6.

In a non-illustrated modified embodiment, the row of connecting webs 13 may be replaced by a single connecting web that continuously extends across the entire length of the row.

The invention claimed is:

1. A doctor blade device, comprising:

a doctor blade;

two side walls each having at least one respective protrusion;

each of said two side walls having a respective seal including a blade contacting section having a front side engaged with the doctor blade and a rear side being softer, more elastic or more resilient than said front side, said respective seal having a connecting groove fitting onto said at least one respective protrusion when said respective seal is fitted onto a corresponding one of said two side walls.

2. The device according to claim 1, wherein said rear side has a first pocket formed therein.

3. The device according to claim 2, wherein said front side has a second pocket formed therein.

4. The device according to claim 3, wherein said first pocket and said second pocket have dimensions adapted to each other to ensure that when pressure is exerted on said blade contacting section or said front side of said blade contacting section by the doctor blade engaged therewith, said rear side with said first pocket reacts in a more resilient way than said front side with said second pocket, and said front side is more dimensionally stable than said rear side.

5. The device according to claim 4, wherein said first pocket is deeper than said second pocket.

6. The device according to claim 2, wherein said first pocket is wider than said connecting groove.

7. The device according to claim 1, which further comprises an upper end and a lower end of the seal, said upper end and said lower end having different contours.

8. The device according to claim 7, wherein said lower end forms said blade contacting section and said upper end forms an engagement surface for a stop on said side wall.

* * * * *